US005834065A

United States Patent [19]

Feldstein

[11] Patent Number: 5,834,065

[45] Date of Patent: Nov. 10, 1998

[54] COMPOSITE PLATED ARTICLES HAVING LIGHT-EMITTING PROPERITES

[75] Inventor: Nathan Feldstein, Princeton, N.J.

[73] Assignee: Surface Technology, Inc., Trenton, N.J.

[21] Appl. No.: 446,129

[22] Filed: May 22, 1995

Related U.S. Application Data

[60] Division of Ser. No. 295,563, Aug. 25, 1994, Pat. No. 5,516,591, which is a continuation-in-part of Ser. No. 236, 005, May 2, 1994, abandoned, which is a continuation of Ser. No. 976,387, Nov. 13, 1992, abandoned.

[51] Int. Cl.[6] ..... C25D 7/00; C25D 15/00

[52] U.S. Cl. ..... 427/405; 427/419.1; 427/419.2; 427/419.3; 427/157

[58] Field of Search ..... 427/576, 157, 427/405, 419.1, 437, 443.1, 419.2, 419.3

[56] References Cited

U.S. PATENT DOCUMENTS

| | | | |
|---|---|---|---|
| 4,327,120 | 4/1982 | Siemers et al. | 427/34 |
| 5,514,479 | 5/1996 | Feldstein | 428/544 |

*Primary Examiner*—Daniel J. Jenkins

[57] ABSTRACT

This invention discloses processes and articles for the manufacturing of composite plated articles comprising finely divided particulate matter dispersed within metallic matrices and having light emitting properties, such articles being useful in the metallization of articles and their reuse through subsequent rejuvenation, without damaging the base metal of said articles.

7 Claims, No Drawings

COMPOSITE PLATED ARTICLES HAVING LIGHT-EMITTING PROPERITES

REFERENCE TO PRIOR APPLICATIONS

This application is a divisional of Ser. No. 08/295,563 filed Aug. 25, 1994 now U.S. Pat. No. 5,516,591 which is continuation in part of application Ser. No. 08/236,005 filed May 2, 1994 now abandoned which is a continuation to application Ser. No. 08/976,387 filed Nov. 13, 1992 now abandoned.

BACKGROUND OF THE INVENTION

The textile industry utilizes at high speed various kinds of machinery parts for processing textile fibers. Examples of other industries using machinery parts at high speed are the paper industry, the tobacco industry, molding of parts and others. The speed at which the fibers (or other materials) move through the parts results in abrasion to the machinery parts; the parts suffer wear and degradation and must eventually be discarded. It is well known in the art that sharp-toothed wire, or the like, is used in many areas of carding, spinning, and related textile operations. In open-end spinning, for example, a sliver of separate fibers is fed into a combing roller which has metallic wires wound around the periphery of the roller, which wires are of a saw-toothed structure. The wires contact the fibers and comb them. The fibers are then transferred from the combing roller to a rotor where the combed fibers are twisted to form a yarn which is then transferred to a take-up spool. Examples of combing rollers with various toothed combing wires thereon can be found in U.S. Pat. Nos. 2,937,413; 4,233,711; 2,731,676; 4,435,952; 4,358,923; 4,859,494 and 3,833,968 which patents are incorporated herein by reference. A more recent version of the wire combing roller is a homogeneous substrate of the teeth and sleeve machined from a single metal stock. An alternative device to the combing roller is a pin-ring which functions in the same way as the combing roller, but employs a multiplicity of pins extending from the roller (sleeve) rather than the toothed surface. For the purpose of this invention, the terms "combing rolls", "carding rolls", "pin-rings", and "beater rolls" (or "rollers") are used interchangeably.

These rollers are currently driven at speeds of 5,000–10,000 RPM (as described in U.S. Pat. No. 4,435,953), which cause tooth wear with time, with higher speeds expected in the future. Thus, the efficiency of the entire operation is adversely affected. Tooth wear lower the quality of the product produced over time, causing knots and neps in the yarn produced; it also causes yarn breaks, which in turn cause an individual spinning position either to shut down or to produce defective yarn.

The wire (or pins, in the case of pin-ring beater rolls) containing the teeth that do the fiber combing is generally made from steel. The wire is essentially comprised of two different parts: (1) the base of the wire, and (2) the toothed portion of the wire. Although the methods of manufacture and the specifications for the final wire or teeth vary from one manufacturer to another, it is a common practice to start with a wire initially haing a round section configuration. The section configuration is modified by a process of rolling to provide a wire which is finally strip-like, with a rib running along one side to constitute a base or foundation for the finished strip (as described in U.S. Pat. No. 2,731,676). After suitable treatment which makes the wire metallurgically suitable in terms of hardness, ductility, and, hopefully, wear resistance, this base portion is then embedded in the combing roller, be it a solid piece or a sleeve.

One commonly used method for the formation of the toothed portion itself is a punching operation which imparts the shape of the tooth while also producing the proper angles for the most efficient carding and combing of a specific type of fiber.

Following the punching operation, another mechanical process used (described in U.S. Pat. No. 4,233,711) is a grinding operation. The primary function of the grinding operation is to impart an evenness to the teeth, making them all exactly uniform, as well to remove any unwanted residual defects resulting from the punching operation. As a final step, some manufacturers post treat the wire using "needle finishing" which imparts a smoothness to the sides of the teeth, along with a very light, or minimal, amount of directional lines in the steel teeth, which lines run approximately parallel to the base portion of the wire. The grinding operation also helps the efficiency of the combing operation by reducing undesired "loading" of the teeth.

Degradation of the tooth geometry occurs with use, i.e., dulling of the sharpness of the tip of the tooth and the dulling of the tooth edges which eventually leads to the general wear of the entire tooth portion of the wire. Various coatings or wire treatments, applied by the diffusion treatment process, have been devised and attempted to prevent excessive wear, or to slow down the wearing process. Examples of such coatings and wire treatment are heat treatment of carbon nitriding; surface hardening by carbon nitriding; electro-spark coating (including vanadium carbide, chromium carbide, tungsten carbide, titanium carbide, zirconium carbide, hafnium carbide, and iron boride).

In still another process, a chromium layer is electrodeposited onto the teeth of the combing roll, imparting a hard chromium wear resistant layer over the steel teeth (as described in U.S. Pat. No. 4,169,019).

A more popular, and seemingly more wide-spread, method of protecting the combing teeth is by the electroless deposition of a "composite" coating. These composite coatings are usually comprised of small particles which are codeposited along with an electroless metal matrix (usually, but not limited to, a nickel-phosphorous type matrix). The wear resistant particles can range from aluminum oxides and silicon carbides, to natural and synthetic diamonds (both polycrystalline and/or monocrystalline in nature). Lubricating particles (e.g., fluorocarbon polymers, graphite flouride and others) may also be used in composite deposition. These coatings, and their like, may be applied according to the technology taught in U.S. Pat. Nos. 3,617,636; 3,940,512; 4,358,923; 4,547,407; 4,666,786; 4,419,390; Re. 29,285; 4,358,923; 4,859,494, 4,997,686; 5,195,517; 5,300,330; 4,830,889 which patents are incorporated herein by reference. A review of this composite electroless technology can be found in Chapter 11 in the text "Electroless Plating Fundamentals and Applications", G. O. Mallory and J. B. Hajdu, editors, published by the American Electroplaters and Surface Finishers Society, 1990.

In the prior art of composite plating and particularly composite electroless plating, particulate matter having the generic properties of wear resistance, lubricity, and/or corrosion resistance were advocated and used.

After the wear resistant coating is depleted, the underlying surfaces of the combing teeth degrade, and wear away with relative rapidity. Once this degradation occurs, either the combing apparatus is discarded, or the old teeth are removed and are replaced by the insertion of new teeth. These procedures are both expensive and not very cost effective. It would therefore be desirable to enable the attainment of maximum use from the protectively coated combing apparatus (or other apparatus or machinery parts) without degradation of the teeth so that the usage can be extended to multiple generations.

In commercial usage of plated molds, when deterioration of the plated articles occurs, grinding and polishing of the worn mold must sometime be effected before a new generation of plating can be undertaken. These additional mechanical operations are time consuming and costly, and hence undesirable.

SUMMARY OF THE INVENTION

Broadly, the invention comprises an apparatus useful in textile manufacturing machinery, though it is not limited to textile machinery. The apparatus (machinery part) comprises a base metal and functional coating for either wear resistance, lubricity, or corrosion resistance thereof, and is characterized by the presence of an indicator layer interposed between the base metal and the functional coating. The interposed indicator layer, directly or indirectly, signals to an operator or a supervisor of the machine that the functional coating has been consumed, thereby enabling removal of the part from the machinery before further use causes irreparable degradation of the base metal. A preferred indicator layer would be comprised of fine particulate matter dispersed in a metallic matrix that has light emitting properties. The invention further comprises methods for producing such an apparatus.

It should be understood that the invention is not intended to be limited to any particular base metal, indicator layer, or functional coated layer, and that the apparatus may also include other layers either under or over the wear resistant layer such as may be employed in the art for other functions, e.g., promoting adhesion of the base metal.

The substrates contemplated in the present invention can range from dielectrics, semiconductors, metals and alloys with the standard pretreatment schedule required for the specific substrate prior to the plating step. The metallic matrixes contemplated in this invention are the wide variety of metal and alloys that can be deposited by electrolytic and/or electroless plating techniques. Accordingly, the present invention is not limited to a specific substrate nor to any specific metal to be plated.

DETAILED DESCRIPTION OF THE INVENTION

I have recognized that in order to obtain maximum use of certain apparatus (machinery parts) used in textile manufacturing machines (or machinery parts used in other industries) which comprise a base metal and a functional coating thereof, such that the apparatus is capable of being relatively inexpensively rejuvenated, one must interpose an indicator layer between the wear resistant (functional) layer and the base metal to signal that the functional layer has been, or is about to be, depleted, prior to irreversible degradation of the base metal. As used herein, the term "functional coating" refers to a coating which is generally applied for rendering the substrate with certain improved properties ranging from wear resistance, lubricity and corrosion.

The indicator layer may function in many different ways. For example, it may provide a visual indication by being a different color than the overlying functional layer, e.g., protective wear resistant layer; or it may provide a visual indication by the incorporation of luminescent particles or pigments; or it may provide for a change in the friction forces (either by more, or less, friction) which can be measured or would otherwise be detectable by an operator of the machine, or be measured automatically; or it can cause an alteration in the processed fiber which is detectable as being characteristic of the wear on the part in question.

By way of example of the invention, but in no way intended to be limiting, the invention applied to the coating of a combing roll of the type used in open-end textile spinning machines. It should be understood that the invention is not limited to an apparatus with only an indicator layer and a wear resistant layer. In practice, the novel apparatus may also include other layers, either under and/or over the wear resistant layer and/or indicator layer.

Typically, suitable wear resistant layers include: nitride, carbide, or oxide layers, particularly those of the refractory metals such as titanium, hafnium, and tungsten, or those of aluminum, silicon and boron; metallic layers such as chromium or nickel or alloys thereof; and composite layers comprising a metal such as chromium or nickel having small wear resistant particles codeposited therewith. These particles typically can include: metallic oxides, carbides, or nitrides; diamonds; or lubricating particles such as Teflon, graphite, fluoride particles and the like. The methods for depositing coatings of the types set forth above are well known in the art.

The indicator layer may be selected from a variety of materials, as long as the indicator layer is capable of indicating that the functional layer has eroded. For example, the indicator layer may be a copper layer plated on the substrate such that when the composite layer has worn through, or eroded, the characteristic copper color is visible. For example, the indicator layer may be a material capable of giving off a detectable odor upon erosion of the functional layer, e.g., a layer containing a sulphide therein. Still further, when the wear resistant functional layer is a composite, the indicator layer may contain particles of a different mean size than the particles in the composite layer, or particles of a different type. Here, upon erosion of the composite layer, such different particle size or particle type would be detectable due to a change in the frictional forces on the apparatus or a change in the processed fibers.

Still another example of a suitable indicator layer is a composite layer having luminescence particles therein. Such a layer can be produced, for example, by incorporating a small amount of a fluorescent dye in Teflon particles, and/or fluorescent particles, and/or phosphoresence particles.

The finely divided particulate matter referred herein are particles comprised of atoms or molecules that absorb photons of electromagnetic radiation and reemit the absorbed energy by the spontaneous emission of photons which, however, are not of the same energy as absorbed photons or the same wavelengths. The phenomenon is generally referred to as luminescence, having light emitting properties.

Luminescence is further classified into fluorescence and phosphorescence. If the emitted radiation continues for a noticeable time (generally between $10^{-4}$ to 100 seconds) after the incident radiation is removed, it is referred to as phosphorescence. If the emission cease almost immediately, ($10^{-4}$–$10^{-9}$ seconds) after the incident radiation is removed, the process is referred to as fluorescence. Specific examples of such materials include pure solids of known chemical composition or naturally occurring minerals.

It is apparent from the above that a wide variety of materials can usefully be employed as the indicator layer. The only requirement of the indicator layer is that it be capable of expressing or signalling erosion of the functional composite layer.

Broadly, the novel apparatus may be produced by the steps of depositing a indicator layer over at least the portion of the base metal which is exposed to wear or erosion during use. Typically, this layer would be five microns and above in thickness. However, the thickness of this, or any other, layer is not critical; substantially, any desired thickness may be suitable. As previously set forth, additional layers either under, over, or between the indicator and/or wear resistant layers may be formed during the process. The specific techniques for depositing or forming the various layers are well known in the art and need not be set forth in detail herein.

In a preferred embodiment of the invention, the wire for the combing roller is provided with several microns in thickness of an electroless or electroplated copper coating. A wear resistant (functional) nickel layer having diamond particles dispersed therein is electrolessly plated over the copper layer. The wear resistant (functional) layer is typically 0.8 mil thick. In use, when the wear resistant layer is worn away, thereby exposing the copper layer, the presence of the copper layer on the surface may be detected automatically by means of electrodes for detecting the sudden increase in surface conductivity due to the expose copper or by visual means. Based upon the present teachings, it should be recognized that the indicator layer can be a plated composite film derived by either electrolytic or electroless plating methods. Similarly, the working film can be a lubricating film, a wear resistant film, or a corrosion resistant layer. It is also recognized that the plated composite layer bearing the finely divided particulate matter having light emitting properties are new articles not previously available.

The following example is provided to further illustrate the present invention in the process and articles having light emitting properties. 3.3 g/l of finely divided cool white halophosphor powder (calcium halophosphate type) was dispersed into commercial electroless plating bath NiPLATE 300 (sold by Surface Technology, Inc., Trenton, N.J.). The bath was heated to 175° F. and adjusted to a pH value of 6.4. A clean metallic rod was immersed and plated for 1.5 hr. Upon completion of the cycle, the rod was analyzed by two separate means: (1) light from a UV lamp was applied upon the coated surface, resulting in a distinct white visible color, and (2), a portion of the coated rod was cross-sectioned to note the presence of codeposited particles within the metallic matrix. The codeposited particles were a few microns in size. Though this example was executed via electroless metal deposition technique, it is obvious that other techniques can be substituted, such as electroless plating, spray deposition, all yielding similar composites. Further examination of the coating revealed good quality as to adhesion and integrity of the coating. Moreover, the coating appeared to successfully retain its properties even after a heat-treatment cycle at 350° C. Though in this example white halophosphor particles were used, other particles of different colors can similarly be used, still falling within the spirit of this invention. Further surprising was the fact that the particles were compatible within the plating composition without detrimental effects such as poisoning of the bath or their decomposition by ionization. This example was further refined by the selective deposition of the a functional layer onto the above indicator layer. The selective deposition provided an electroless coating with fine windows (dots) of 1 to 2 mm windows exposing the indicator coating. Upon shining a UV light a bright glow (in a dot pattern) was observed.

In another example, a composite nickel layer containing 2 micron diamond is deposited as the wear-resistant layer. This layer is friendly for many textile applications; and it has a thickness of 20 to 25 microns and a weight density of diamond of about 18%. An indicator layer comprising diamond particles of 4 microns is deposited in a similar fashion between the substrate and the wear-resistant (functional) layer. As the wear layer wears out, the new frictional forces attributed to the 4 micron size diamonds affect the yarn properties, thereby signaling to an operator that it is time to replace the part(s). The worn parts are to be replaced with a new parts, in so doing preserving the used worn parts for recoating for a subsequent use.

In another example, calcium tungstate at a concentration of 5 g/l was incorporated along with the NiPLATE 300 electroless plating bath. A rod similar to the above was plated for 1 hour at a pH of 6.4 and a temperature of 78° C. After the plating cycle, irradiation of the rod with a UV light resulting in the emission of blue color.

Other areas where such coating are of potential use is the security area. Specifically, objects can be coated in part or in total and verified for their authenticity via their light-emitting properties.

What I claim is:

1. A process for manufacturing a composite plated article having light emitting properties, said article having a substrate, said process comprising providing a plating bath containing finely divided particulate matter having light emitting properties, contacting said substrate with said plating bath, and plating a metallic matrix with said finely divided particulate matter dispersed therein from said plating bath onto said substrate of said article.

2. The process according to claim 1 further provided with a functional coating.

3. The process according to claim 1 wherein said composite article is deposited via an electrolytic plating method.

4. The process according to claim 1 wherein said composite article is deposited via an electroless plating method.

5. A process for manufacturing a composite plated article having light emitting properties, said process comprising plating a metallic matrix with finely divided particulate matter dispersed therein onto a substrate, said particulate matter having light emitting properties, and providing a functional coating.

6. A process for manufacturing a composite plated article having light emitting properties, said process comprising plating a metallic matrix with finely divided particulate matter dispersed therein onto a substrate, said particulate matter having light emitting properties, wherein said plating comprises an electrolytic plating method.

7. A process for manufacturing a composite plated article having light emitting properties, said process comprising plating a metallic matrix with finely divided particulate matter dispersed therein onto a substrate, said particulate matter having light emitting properties, wherein said plating comprises an electroless plating method.

* * * * *